United States Patent [19]

Gerber

[11] 4,292,489

[45] Sep. 29, 1981

[54] TAB HEATING AND APPLYING APPARATUS

[75] Inventor: Howard L. Gerber, Park Forest, Ill.

[73] Assignee: The Continental Group, Inc., New York, N.Y.

[21] Appl. No.: 965,679

[22] Filed: Dec. 1, 1978

[51] Int. Cl.[3] ..... H05B 6/10; H05B 6/44

[52] U.S. Cl. ..... 219/10.71; 219/10.79; 219/10.53; 336/79; 156/380

[58] Field of Search ..... 219/10.69, 10.71, 10.75, 219/10.79, 10.57, 10.49 R, 10.77, 10.61, 10.73, 10.41, 10.51, 10.53; 156/273, 274, 275, 380; 336/79, 73, 75

[56] References Cited

U.S. PATENT DOCUMENTS

| | | | |
|---|---|---|---|
| 1,981,632 | 11/1934 | Northrup | 219/10.79 |
| 2,151,035 | 3/1939 | Kennedy | 219/10.75 |
| 2,428,705 | 10/1947 | Finger | 219/10.79 |
| 2,471,471 | 5/1949 | Wood | 219/10.79 |
| 2,747,066 | 5/1956 | Brace | 219/10.71 |
| 2,942,089 | 6/1960 | Baker et al. | 219/10.69 |
| 3,133,179 | 5/1964 | Armstrong et al. | 219/10.69 |
| 3,185,810 | 5/1965 | Peschel et al. | 219/10.69 |
| 3,223,519 | 12/1965 | Schippereit | 219/10.79 |
| 3,397,297 | 8/1968 | McCorry | 219/10.69 |
| 3,443,049 | 5/1969 | Hoagland | 219/10.79 |
| 3,461,215 | 8/1969 | Reboux | 219/10.49 |
| 3,686,459 | 8/1972 | Lewis | 219/10.75 X |
| 3,720,803 | 3/1973 | Lewis | 219/10.69 |
| 3,849,625 | 11/1974 | Trine | 219/10.79 |
| 4,104,498 | 8/1978 | Gerber | 219/10.79 |

*Primary Examiner*—Gene Z. Rubinson
*Assistant Examiner*—Philip H. Leung
*Attorney, Agent, or Firm*—Charles E. Brown

[57] ABSTRACT

An apparatus for applying tabs to end units wherein the tabs are in the form of an aluminum foil-plastic film laminate. A heating dial is provided for receiving tabs, rotating the tabs by indexing, and then applying the tabs. The heating dial includes a radio frequency transformer which includes a fixed primary winding and a segmented secondary winding which is rotatable as a unit together with heating elements secured thereto. The secondary winding segments are circumferentially spaced and each heating element is secured to two adjacent segments in bridging relation.

15 Claims, 6 Drawing Figures

TAB HEATING AND APPLYING APPARATUS

This invention relates in general to new and useful improvements in radio frequency heaters, and more specifically to a heater for the induction heating of plastic coated aluminum tabs of the type applied to easy opening containers.

In accordance with this invention it is proposed to provide a dial type device for receiving tabs and rotating the tabs from the receiving station to an applying station in an indexing manner and during the rotation of the tabs effecting the heating thereof so as sufficiently to soften the plastic coating to make it bondable to an end unit which may have been also previously heated.

The heating dial includes a primary coil which is fixedly mounted in a segmented secondary coil which is rotatable relative to the primary coil while having high frequency electrical current constantly induced thereinto from the primary coil.

In accordance with this invention the secondary coil is in the form of a single winding coil formed of a plurality of spaced apart segments which are joined together at at least one end by an insulator base. The insulator base carries one heating element for each segment with each heating element bridging two segments whereby current flow is induced into the segments, the current flowing toward the edges of the segments and down the edges to the respective heating elements.

In accordance with this invention the opposite ends of the secondary coil segment may also be joined by an insulated base which carries an indexing gear.

Each heating element is provided with a tab engaging face and this face includes a heating component which is of a generally hollow construction and so configurated so as to heat the associated tab in a predetermined pattern. The heating component is preferably filled with a ferrite core and is surrounded by additional ferrite material so as to provide for the concentration of high frequency electrical current for inducing such current into the metal of the tab, thereby providing for controlled heating of the tab.

The tabs may be held on their respective heating elements by means of vacuum produced in the face of the heating elements with there being a vacuum manifold controlling the extent of holding.

With the above and other objects in view that will hereinafter appear, the nature of the invention will be more clearly understood by reference to the following detailed description, the appended claims, and the several views illustrated in the accompanying drawings.

IN THE DRAWINGS

Figure 1:
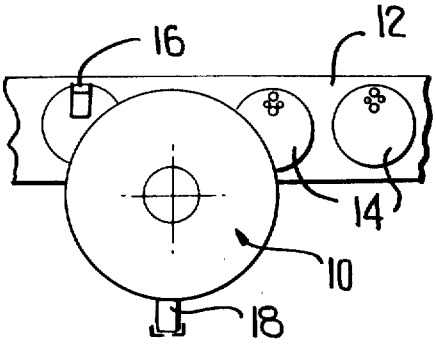
FIG. 1 is a schematic plan view of the tab applying apparatus.

Referring now to the drawings in detail, in FIG. 1 it will be seen that there is illustrated a rotary dial, generally identified by the numeral 10, for heating tabs for application to end units. The rotary dial 10 is mounted for indexed rotation with the dial being preferably indexed four times for each complete revolution thereof.

The dial overlies a conveyor 12 for end units 14 of the easy opening type. The end unit are sequentially presented beneath the dial 10 and have applied thereto conventional tabs 16 which are preferably in the form of a laminated construction including a metal outer layer having a plastic film coating. The outer layer is preferably in the form of aluminum foil.

The tabs are sequentially applied to the dial 10 at the underside thereof by a tab feed mechanism 18. It is to be understood that as each heating element of the dial 10 becomes aligned with the tab supply mechanism 18, a tab will be supplied that heating element. Preferably there are four heating elements in a manner to be described hereinafter so that the dial 10 has to be indexed twice before a tab is transferred from the tab supplying station to the tab discharging station. It is envisioned that the heating dial 10 may be indexed at the rate of 500 strokes per minute. Since two full strokes are required to index a tab from the supply station to the discharge or application station, an elapsed time of 240 milliseconds would be provided for tab heating.

Although no specific details of the conveyor 12 or other means for feeding the end units 14 have been specifically illustrated, it is to be understood that suitable heater means may be provided for heating the end units which is in advance of their presentation to the heating dial 10. Also, it is to be understood that suitable means will be provided for elevating an end unit so as to engage the tab carried by the associated heating element to effect transfer of the tab from the dial 10 to the respective end unit 14.

The dial 10, which is the primary component of this invention, includes a suitable housing 20 which may be formed of aluminum and which is carried by a suitable support 22. The housing 20 surrounds a primary coil 24 of a high frequency transformer. The primary coil 24 is in the form of a plural turned winding 26 formed of a tubular material. The adjacent tube portions are separated from one another and the windings are surrounded on three sides by a ferrite-epoxy 28.

The ends of the windings 26 will be coupled to a suitable coolant (water) supply in a conventional manner. Also, the ends of the coil will be attached to a source of radio frequency electrical energy 30 in a conventional manner.

Figure 4:
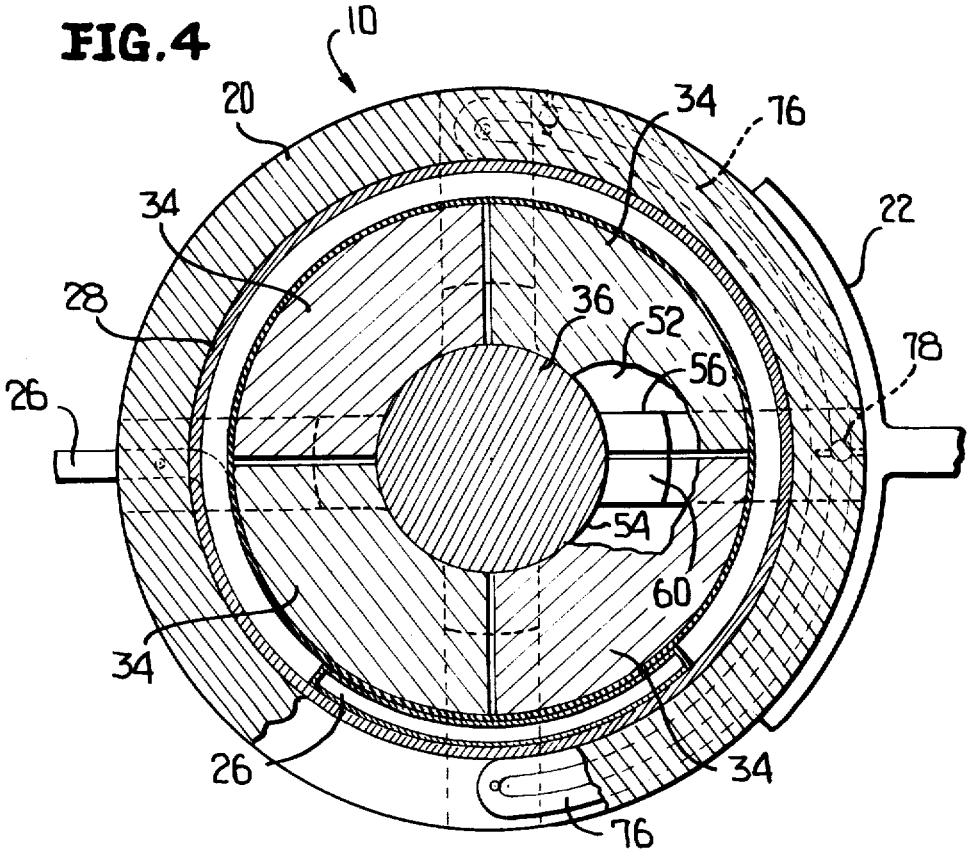
FIG. 4 is a horizontal sectional view taken along the line 4—4 of FIG. 3.

The transformer also includes a single turn secondary coil generally identified by the numeral 32. The secondary coil 32 is in the form of a plurality of segments 34, as is best shown in FIG. 4, there being four segments in the preferred embodiment of the invention. The segments 34 are disposed in circumferentially spaced relation about a central ferrite core 36 so that opposed faces of the segments 34 are in spaced relation.

The upper ends of the segments 34 are secured by means of suitable fasteners 38 to an upper insulator base or plate 40. The plate 40 generally seats on the housing 20 and serves to support the secondary coil 32 for indexed rotation within the primary coil 24.

In order that the secondary coil 32 may be indexed, the insulator plate 40 has secured thereby by means of suitable fasteners 42 a driven gear 44 which is engaged by a drive gear 46 carried by the shaft 48 of an electric motor 50. It is preferred that the gear 46 be one-quarter the diameter of the gear 44 so that during each indexing of the dial 10 the motor 50 will turn one revolution.

There is secured to the undersides of the segments 34 an insulator base 52. The insulator base 52, as is best shown in FIG. 4, has a central circular opening 54 for receiving the core 36 and is provided with notches 56 surrounding the core for a purpose to be described hereinafter.

Figure 3:
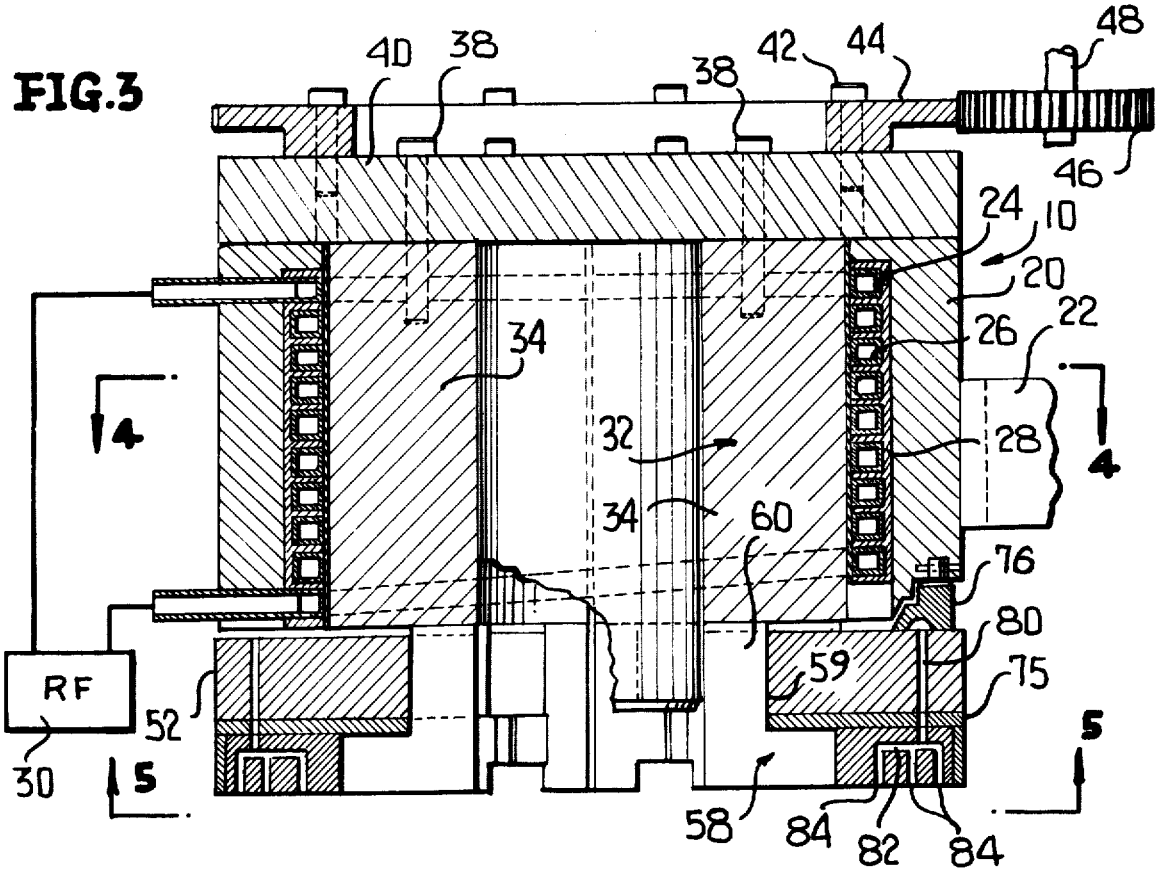
FIG. 3 is an enlarged vertical sectional view taken along the line 3—3 of FIG. 2, and shows the constructional details of the heating dial.

The insulator base 52 carries a plurality of heating elements, generally identified by the numeral 58, there being one heating element for each segment 34. Each heating element is of a generally L-shaped outline in elevation, as is clearly shown in FIG. 3, and includes an upstanding leg 60 which extends through a respective notch 59 in the insulator base 52. The upper end of each leg 60 is engaged with the underside of two adjacent segments 34, each heating element 58 bridging the gap between two segments 34.

Figure 5:
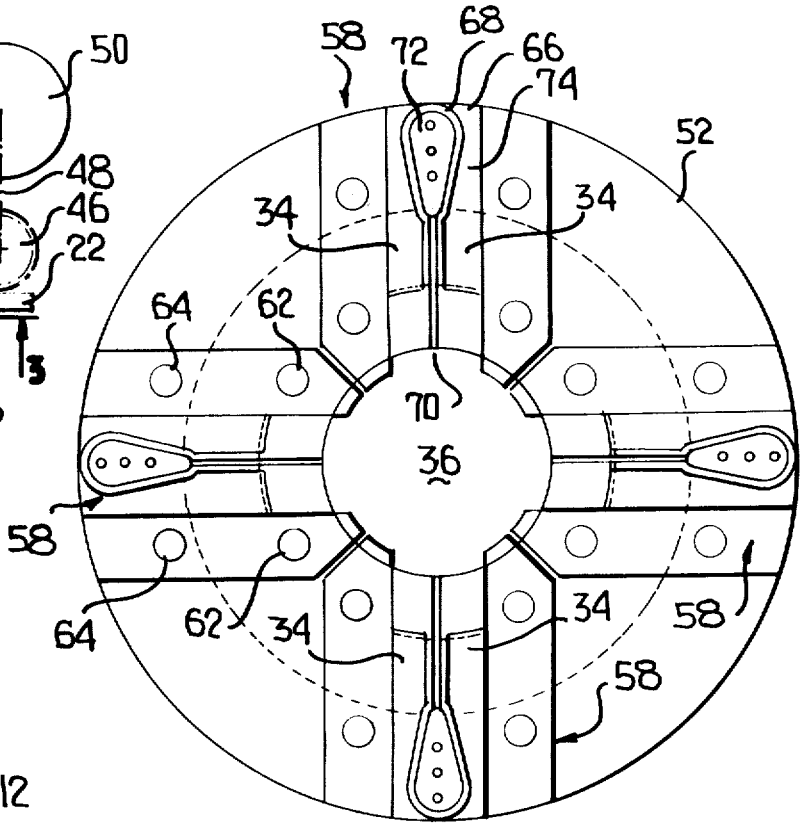
FIG. 5 is a bottom end view of the heating dial taken along the line 5—5 of FIG. 3.

Referring now to FIG. 5, it will be seen that each heating element is secured to a respective segment 34 by a pair of fasteners 62, these fasteners extending through the insulator base 52 and extending into the segments 34 electrically to connect the heating elements 58 to their respective segments. A second pair of fasteners 64 also secure each heating element 58 to the insulator base 52.

At this time it is pointed out that the secondary coil 32 and the heating elements 58 could also be water cooled, and if so, there would be suitable coolant passages formed therein which passages are not illustrated.

It is to be noted that each heating element 58 includes a downwardly depending tab engageable face 66 which is generally of a size corresponding to a tab to be applied. The tab engageable face 66 has a heating component 68 which is generally of a hollow outline in accordance with the configuration of the desired seal between a tab and an associated end unit. This configuration is oval.

It is also to be noted that each heating element 58 is longitudinally split as at 70 with the split being in alignment with the space between adjacent segments 34. The split 70 extends into the interior of the heating component 68.

The interior of the heating component 68 is filled with ferrite-epoxy 72. The heating component 68 is also surrounded with ferrite-epoxy 74. Further, a ferrite slab 75 is disposed between the upper side of the heating element 58 and the insulator base 52. Thus there may be a concentrated current flow from the primary coil 24 into the segments 34 of the secondary coil 32, toward the edges of the segments 34, down along the opposed faces of adjacent segments, and through the respective heating element with the high frequency electrical energy being concentrated on the heating component 68 for the controlled induction of high frequency electrical energy into the aluminum foil layer of an aluminum foil-plastic film laminated tab.

In order that the tabs may be retained on the underside of the heating elements 58, a vacuum system is provided. The vacuum system includes a manifold 76 which is carried by the underside of the housing 20 and is coupled to a suitable manifold line 78.

The insulated base 52 and the associated ferrite slab 76 are provided with a vacuum passage 80 which opens through the upper surface of each heating element 58 into a vacuum passage 82 having a plurality of ports 84 opening through the face of the ferrite core 72.

As is best shown in FIG. 4, the manifold 76 extends only through an arc of 180° so that the vacuum is not depleted by the absence of a tab as the heating element 58 passes from the applying station back to the tab supplying station 18.

It is to be understood that in the operation of the apparatus, the conveyor 12 and the heating dial 10 will be indexed in sequence so that as the dial 10 is indexed one-quarter revolution, the conveyor 12 will be advanced one end unit spacing. Thus, each time an end unit 14 is presented beneath the heating dial 10, the heated tab will be turned in overlying oriented relation to an underlying end unit 14. When the end unit is pressed up against the underside of the tab 16, the plastic layer of the tab will have been sufficiently heated so as to bond to the end unit and thus when the end unit is retracted, the newly applied tab will be drawn from its respective heating element 58 with the end unit 14.

Figure 2:
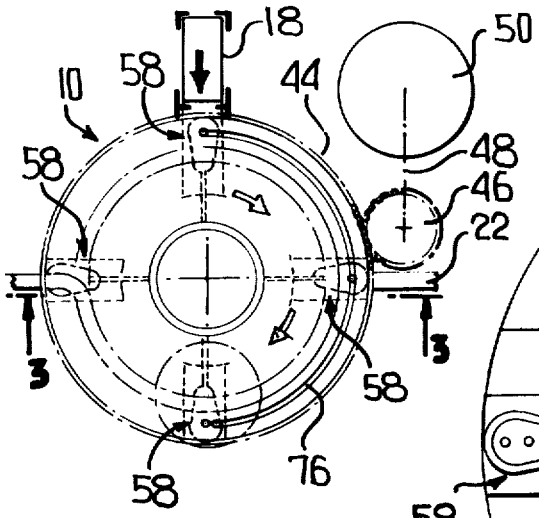
FIG. 2 is a bottom plan view of the heating dial.

As will be apparent from FIG. 2, the dial 10 is indexed twice to move the tab from the tab supplying station to the tab applying station, and the time required for this two-step indexing will be sufficient to effect the heating of the plastic layer of the tab to a bonding temperature.

Figure 6:
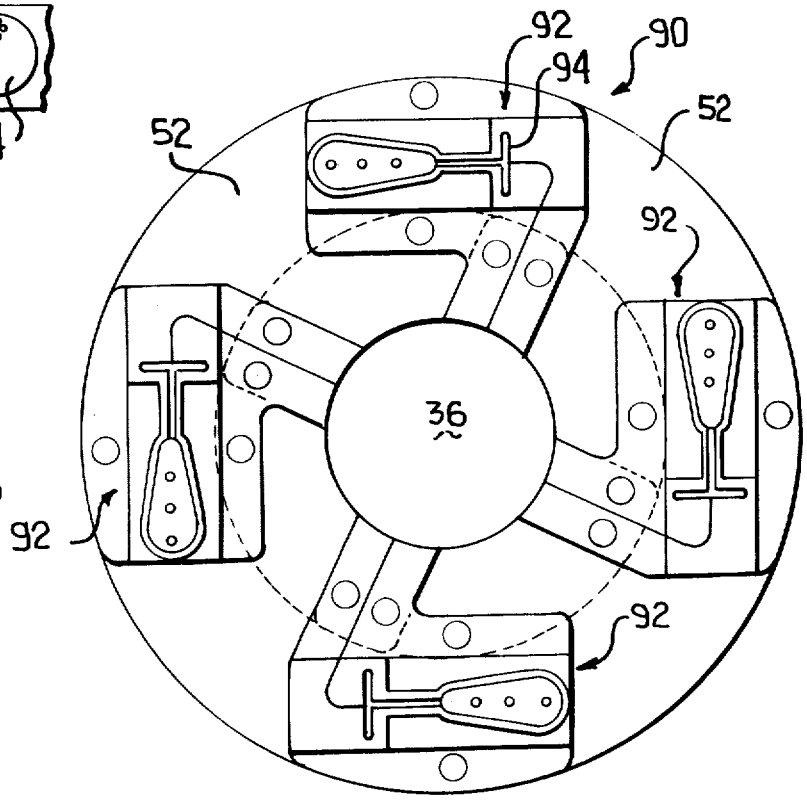
FIG. 6 is a bottom view similar to FIG. 5, showing a modified dial construction.

Reference is now made to FIG. 6 wherein a slightly modified form of heating dial 90 is illustrated. The heating dial 90 will be of the same construction as that of the heating dial 10 except that the configuration of the heating elements 92 thereof have been changed from those of the heating elements 58. Primarily the change resides in that the heating elements 58 extend radially whereas the heating elements 92 extend generally chordal or tangential. It is to be understood that minor changes will be required in the bolt patterns for receiving the fasteners which secure the heating elements 92 to the secondary coil segments 34 and the insulated base 52.

The tab engaging faces of the heating elements 92 correspond very closely to those of the heating elements 58 except that a transverse slot 94 may be in the heating element in that the equivalent of the slot 70 is of an angular configuration. The slot 94 will be filled with ferrite-epoxy and the ferrite will serve to concentrate the electrical current in the heating element 92.

Although only several preferred embodiments of the invention have been specifically illustrated and described herein, it is to be understood that minor variations may be made in the apparatus for applying tabs to end units without departing from the spirit and scope of of the invention as defined by the appended claims.

I claim:

1. An induction heating apparatus comprising a fixed primary coil, a circumferentially segmented secondary coil formed of a plurality of circumferentially spaced and adjacent separate segments and telescoped relative to said primary coil, means mounting said secondary coil for rotation relative to said primary coil, and a like plurality of induction heating elements carried by said segments of said seconary coil at one end thereof, the number of induction heating elements being equal to the number of secondary coil segments.

2. The induction heating apparatus of claim 1 wherein said primary coil is a plural turn winding, and said secondary coil is a single turn coil formed by a total of said separate secondary coil segments.

3. The induction heating apparatus of claim 1 together with a single central ferrite core.

4. The induction heating apparatus of claim 1 together with an indexing drive coupled to said secondary coil for sequentially indexing said secondary coil and said heating elements.

5. The induction heating apparatus of claim 1 wherein each of said heating elements is coupled to two and only two of said secondary coil segments in bridging relation.

6. The induction heating apparatus of claim 1 wherein there is a support fixedly mounting said primary coil, said means mounting said secondary coil for rotation including a pair of insulator bases secured to opposite ends of said secondary coil segments and mounting said separate coil segments as a unit in circumferentially spaced relation for said rotation, said bases opposing and radially overlapping opposite ends of said support, and said heating elements being carried by one of said bases.

7. The induction heating apparatus of claim 6 wherein each of said heating elements includes an article engaging face, each heating element has a vacuum port in its article engaging face for applying a vacuum holding force to an article to be heated, and a fixed vacuum manifold carried by said support.

8. The induction heating apparatus of claim 6 wherein there is an indexing drive coupled to the other of said bases for sequentially indexing said secondary coil and said heating elements.

9. The induction heating apparatus of claim 1 wherein said apparatus is particularly adapted to apply plastic coated metal tabs to container end units, and each heating element having a configurated tab engaging face for effecting controlled induced heating of tabs.

10. The induction heating apparatus of claim 9 wherein said configurated face is of a hollow outline.

11. The induction heating apparatus of claim 10 wherein each heating element is of a part split construction extending generally from said secondary coil segments into said hollow outline.

12. The induction heating apparatus of claim 10 wherein the hollow outline of each heating element is filled with a ferrite core.

13. The induction heating apparatus of claim 10 wherein the hollow outline of each heating element is filled with a ferrite core and surrounded by ferrite material.

14. The induction heating apparatus of claim 12 wherein an insulator base is secured to ends of said secondary coil segments, said heating elements are secured to said base, and a ferrite spacer is disposed between each heating element and said base.

15. The induction heating apparatus of claim 9 wherein said apparatus has a first station with means for supplying a tab to each heating element presented to said first station, a second station remote from said first station, and means for presenting an end unit to each heating element at said second station for receiving a heated tab therefrom.

* * * * *